United States Patent [19]

Takagi et al.

[11] 4,298,677

[45] Nov. 3, 1981

[54] DIFFUSION TRANSFER PHOTOGRAPHIC PROCESS

[75] Inventors: Yoshihiro Takagi; Masakado Sakai, both of Minami-ashigara, Japan

[73] Assignee: Fuji Photo Film Co., Ltd., Minami-ashigara, Japan

[21] Appl. No.: 158,035

[22] Filed: Jun. 9, 1980

[30] Foreign Application Priority Data

Jun. 7, 1979 [JP] Japan ..... 54-72102

[51] Int. Cl.[3] ..... G03C 5/54

[52] U.S. Cl. ..... 430/244; 430/251; 430/230

[58] Field of Search ..... 430/244, 251, 230, 408

[56] References Cited

U.S. PATENT DOCUMENTS

| | | | |
|---|---|---|---|
| 3,536,488 | 10/1970 | Land | 430/230 |
| 3,615,438 | 10/1971 | Land et al. | 430/251 |
| 3,765,889 | 10/1973 | Young | 430/230 |

*Primary Examiner*—Won H. Louie, Jr.

*Attorney, Agent, or Firm*—Sughrue, Mion, Zinn, Macpeak and Seas

[57] ABSTRACT

A silver diffusion transfer photographic process using a silver halide photosensitive emulsion layer comprising silver iodochlorobromide or silver iodobromide wherein the iodide comprises from about 6 to 25 mole % of the halide content.

13 Claims, No Drawings

DIFFUSION TRANSFER PHOTOGRAPHIC PROCESS

BACKGROUND OF THE INVENTION

1. Field of the Invention

This invention relates to a diffusion transfer photographic process, and more particularly to an improved photosensitive silver halide to be used as a photosensitive material in the method of forming black and white negative silver images according to the diffusion transfer photographic process as described in U.S. Pat. No. 3,615,438. Hereinafter this method is referred to as the solubilization by incipient development method (hereinafter defined as SID method).

2. Description of the Prior Art

The SID method is a method of forming black and white negative transfer images according to the diffusion transfer photographic process. More particularly, this method utilizes a phenomenon whereby the dissolution in unexposed areas of silver halide particles by a solvent for silver halide is inhibited, and the dissolution in exposed areas of silver halide particles is promoted (that is, promotion of development solubilization), so that silver halide in exposed areas is selectively dissolved in a developer and silver ions are precipitated on an image-receiving layer.

This invention is directed to an improvement in halide composition photosensitive silver halide for use in the SID method.

For providing negative transfer silver images by the SID method, U.S. Pat. No. 3,615,438 discloses a method in which the solvent for silver halide (for example, sodium thiosulfate) and a development solubilization promoter (for example, 1-phenyl-5-mercaptotetrazole) are quantitatively balanced.

According to this method, however, it is difficult in practice to obtain negative transfer silver images for all types of silver halide emulsions, e.g., having different halide compositions. For example, AgBr, AgCl and AgBrCl emulsions are liable to provide positive transfer silver images. Even if negative transfer images are obtained, it is necessary to use a large amount of a development solubilization promoter in order to keep the maximum density ($D_{min}$) at sufficiently low levels. This gives rise to several problems, in that the development requires an unusually long period of time, and the sensitivity and maximum density ($D_{max}$) decrease.

SUMMARY OF THE INVENTION

An object of this invention is to provide an SID method which permits the formation of black and white negative silver transfer images of high sensitivity, having high $D_{max}$ and low $D_{min}$, in a short development period of time.

This object is attained by employing AgBrClI or AgBrI wherein the iodide comprises from about 6 to 25 mole% of the halide content, and preferably comprises from 10 to 20 mole%, as the photosensitive silver halide for use in the SID method.

This invention removes the drawbacks of the prior art, as described above, and markedly increases the discrimination between image areas and non-image areas.

DETAILED DESCRIPTION OF THE INVENTION

This invention provides a silver diffusion transfer photographic process which comprises imagewise exposing a silver halide photosensitive emulsion layer, and processing the silver halide photosensitive emulsion layer with an alkali processing solution in the presence of a silver halide solvent, a silver halide developer, silver halide, and a development solubilization promotor that forms an insoluble complex compound by reacting with the silver halide, to thus forms black and white negative silver transfer image in an image-receiving layer, wherein the silver halide in the emulsion layer is silver iodobromochloride or silver iodobromide wherein the iodide comprises from about 6 to 25 mole% of the halide content.

The alkali process solution as used in this invention can contain all components used in conventional developers for the positive type diffusion transfer process. That is, it can contain a developing agent, a development retarder, a development promoter, an alkali agent, a silver halide solvent, a thickening agent, and a development solubilization promoter. Of these compounds, the developing agent and development solubilization promoter can be introduced not only into the alkali processing solution, but also into the silver halide emulsion layer. The development solubilization promoter can be introduced simultaneously into the alkali processing solution and into the silver halide emulsion layer.

Any conventional silver halide developing agent can be used in this invention, including hydroquinone, 4-methylaminophenol, ascorbic acid, isoascorbic acid, reductic acid, tetramethyl reductic acid, 2,6-dimethyl-4-aminophenol, toluhydroquinone, 2,6-dimethylhydroquinone, 2-methyl-4-amino-6-methoxyphenol, 2,6-dimethoxy-4-aminophenol, 2,5-dimethylhydroquinone, 2,4,6-triaminophenol, 2,4-diaminophenol, N,N-diethylhydroxylamine, 4,6-diaminooctocresol, and pyrazolidones, such as 1-phenyl-3-pyrazolidone. These silver halide developing agents can be used either singly or in combination with each other.

The amount of the developing agent in the developer (i.e., the alkali processing solution) is generally from about 1 to 80 g per liter of developer, and preferably is from 5 to 60 g per liter of developer. When it is incorporated into the emulsion, the ratio of moles of developing agent/moles of silver halide is from about 1/50 to 1/1, with the ratio range of from 1/10 to $\frac{3}{4}$ being particularly preferred.

The development solubilization promoters are mercapto compounds as described in U.S. Pat. No. 3,615,438. In particular, those compounds represented by the following general formula are preferred:

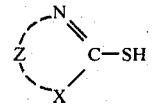

wherein X is O, N or S and Z is a group of atoms forming a heterocyclic ring. Examples of such heterocyclic rings are tetrazole, oxadiazole, oxazoline, imidazole, benzoxazole, purine, triazole, thiadiazole, thiazoline, thiazole, benzthiazole and pyrimidine.

Of the compounds represented by the above general formula, 1-phenyl-5-mercaptotetrazole is especially preferred.

The amount of the development solubilization promoter used in the developer is generally from about 10 mg to 10 g per liter of developer, with the range of from 20 mg to 8 g per liter of developer being particularly preferred. The amount of the development solubilization promoter used in the emulsion layer is from about 0.6 mg to 600 mg per mole of silver halide, with the range of from 6 mg to 300 mg per mole of silver halide being particularly preferred. The amounts of the development solubilization promoter used simultaneously in the developer and in the emulsion layer are 0.6 mg to 300 mg per mole of silver halide in the emulsion layer and 10 mg to 4 g per liter of the developer in the developer.

As the alkali agent, alkali metal hydroxide salts, carbonic acid salts, phosphoric acid salts, boric acid salts, etc. can be used, either singly or in combination with each other. The pH of the alkali processing solution is desirably at least 11.5, and more preferably is at least 12.5.

As the silver halide solvent of the present invention, compounds which react with silver to form complexes and then make the silver halide dissolve as the silver complex can be used. Generally, silver complexing agents of the kind used for a conventional positive diffusion transfer process can be used. Concretely, for example, sodium thiosulfate, potassium thiosulfate, barbital acid, uracil, thioethers and amines can be used.

For the purpose of controlling, for example, gradation, sensitivity, etc., indazoles, imidazoles, triazoles, pyrimidines, pyrazoles, etc. can be used. Thickening agents which can be used in this invention include water-soluble polymers such as carboxy cellulose, hydroxy cellulose, locust bean gum and xanthene gum.

A black and white diffusion transfer photographic element that can be used according to this invention comprises a plastic support, a silver halide emulsion layer, and an image-receiving layer although it is not limited thereto. For example, a peeling type element comprising a portion to be light-exposed, prepared by providing a silver halide emulsion layer on a transparent support, and an image-receiving portion, prepared by providing an image-receiving layer on a transparent support, can be employed. In using such an element, an alkali processing solution is, after imagewise exposure, introduced between the silver halide emulsion layer and the image-receiving layer to effect development, and, thereafter, the silver halide emulsion layer and image-receiving layer are peeled apart from each other. Alternatively, a non-peeling type element comprising a transparent support, an image-receiving layer on the support, and a silver halide emulsion layer on the image-receiving layer, or a transparent support, a silver halide emulsion layer on the support, and an image-receiving layer on the silver halide emulsion layer, can be used. In such elements an alkali processing solution is brought in contact with the silver halide emulsion layer after the imagewise light-exposure, and an image results in the image-receiving layer.

The image-receiving layer can contain one or more silver precipitating nucleus substances. These substances serve to convert transferred silver complex compounds into visible images and provide transferred images having excellent covering power.

Compounds hitherto known as silver precipitating nucleus substances can be used in this invention, including heavy metals, such as zinc, mercury, lead, cadmium, iron, chromium, nickel, tin, cobalt and copper, etc., noble metals, such as palladium, platinum, silver and gold, etc., and sulfides, selenides and tellurides of these metals, etc. These silver precipitating nucleus substances are prepared by forming metal colloidal dispersions through the reduction of the corresponding metal ions in an aqueous solution of a water-soluble polymer such as gelatin, polyvinyl alcohol, carboxymethyl cellulose and methyl cellulose (which is called a protective colloid) or by mixing metal ion solutions with solutions of soluble sulfides, selenides or tellurides to form colloidal dispersions of water-insoluble metal sulfides, metal selenides or metal tellurides. Alternatively the known method can be employed in which a surface layer of a cellulose ester layer is saponified, and silver precipitating nuclei are incorporated therein.

Plastic films which can be used as a support in this invention include a polyester film, a polystyrene film, a polycarbonate film, a cellulose triacetate film, a cellulose propionate film, a cellulose diacetate and like cellulose ester films, etc., and polyethylene-coated paper.

The silver halide emulsion layer of this invention is not limited except with respect to the halide content of the silver halide, and conventional type silver halide emulsions can be used.

The amount of the silver halide coated is generally from about 0.5 to 10 g per square meter, and preferably is from 1.0 to 5.0 g per square meter.

Binders, hardeners, surface active agents, spectral sensitizing dyes, etc., can also be used in the silver halide emulsion layer, and are not subject to special limitations; such additional components can be chosen, for example, from those described in *Research Disclosure*, Vol. 176, pp. 22 to 31 (December, 1978).

The following examples are given to illustrate this invention in greater detail, but this invention is not limited thereto.

EXAMPLE 1

Seven silver halide emulsions, prepared by the double jet process, having an average particle size of 1.2μ, a halide composition of AgBrI, with an iodide content therein within the range of 0 to 30 mole% of the total halide content, as illustrated in Table 1, were coated on a 200μ thick transparent polyethylene terephthalate film support to provide the corresponding photosensitive layer units. The amount of silver coated was 1.7 g/m$^2$.

A coating solution, prepared by dispersing nickel sulfide nuclei in gelatin, said nickel sulfide nuclei being prepared by the formulation and method described in Example 2 of Japanese Patent Publication No. 22950/69, was coated on a 200μ thick transparent polyethylene terephthalate film support to produce an image-receiving layer.

The photosensitive layers were exposed to light and then brought in contact with the image-receiving unit. Between the photosensitive layer and the image-receiving layer a developer having the following formulation was introduced:

| | |
|---|---|
| Water | 40 ml |
| $Na_2SO_3$ | 1.66 g |
| $Na_2S_2O_3$ | 3.2 g |

-continued

| | |
|---|---|
| 1-Phenyl-4-methyl-4-hydroxymethyl-3-pyrazolidone | 60 mg |
| Hydroquinone | 1.68 g |
| KOH (28%) | 6.4 ml |
| 1-Phenyl-5-mercaptotetrazole | 250 mg |
| Hydroxyethyl Cellulose | 2.0 g |

The pH of the developer prepared according to the above described formulation was 13.5.

After development for 4 minutes, the photosensitive layer unit was separated from the image-receiving layer unit. Black and white silver images were formed on the image-receiving layer.

Table 1 indicates the amounts of the silver transferred in both $D_{max}$ and $D_{min}$ areas. In the case of photosensitive silver halide emulsions having iodide contents of from 10 to 20 mole%, the amount of silver transferred was large in the $D_{max}$ area and was small in the $D_{min}$ area. Where the iodide content was 2.5 mole% or less, positive transferred images were obtained.

TABLE 1

| Experiment No. | Iodide Content of Silver Halide Emulsion (mole %) | Amount of Silver transferred at Exposed Area ($g/m^2$) | Amount of Silver transferred at Unexposed Area ($g/m^2$) | Type of Transferred Image |
|---|---|---|---|---|
| 1 | 0 | 0.10 | 0.65 | positive |
| 2 | 2.5 | 0.31 | 0.62 | " |
| 3 | 5.0 | 0.60 | 0.55 | negative |
| 4 (This Invention) | 10.0 | 0.69 | 0.005 | " |
| 5 (This Invention) | 15.0 | 0.67 | 0.01 | " |
| 6 (This Invention) | 20.0 | 0.63 | 0.01 | " |
| 7 | 30.0 | 0.01 | 0.01 | " |

EXAMPLE 2

A photosensitive silver halide emulsion with a halide composition of AgBrClI (Cl: 20 mole%; Br: 70 mole%; I: 10 mole%) and an average particle size of 0.5μ was coated on a support as used in Example 1. The amount of silver coated was 2.0 $g/m^2$.

This photosensitive layer unit was exposed and processed in the same manner as in Example 1, using an image-receiving layer unit and developer as used in Example 1. Black and white negative silver transfer images were formed on the image-receiving layer.

EXAMPLE 3

A photosensitive layer unit as prepared in Experiment No. 1 of Example 1, but using AgBr (i.e., containing no iodide) was processed in the same manner as in Example 1, except that developers in which the $Na_2S_2O_3$ and 1-phenyl-5-mercaptotetrazole contents were changed as illustrated in Table 2 were employed.

Either no image was formed on the image-receiving layer, or a black and white positive silver transfer image was formed on the image-receiving layer. No black and white negative silver transfer images were obtained.

TABLE 2

| | | Developer No. | | | | | |
|---|---|---|---|---|---|---|---|
| | | 1 | 2 | 3 | 4 | 5 | 6 |
| Water | (ml) | 40 | 40 | 40 | 40 | 40 | 40 |
| $Na_2SO_3$ | (g) | 1.66 | 1.66 | 1.66 | 1.66 | 1.66 | 1.66 |
| $Na_2S_2O_3$ | (g) | 3.2 | 3.2 | 3.2 | 1.6 | 0.8 | 1.6 |
| Hydroquinone | (g) | 1.68 | 1.68 | 1.68 | 1.68 | 1.68 | 1.68 |
| 1-Phenyl-4-methyl-4-hydroxymethyl-3-pyrazolidone | (mg) | 60 | 60 | 60 | 60 | 60 | 60 |
| KOH (28%) | (ml) | 6.4 | 6.4 | 6.4 | 6.4 | 6.4 | 6.4 |
| 1-Phenyl-5-mercapto-tetrazole | (mg) | 250 | 350 | 500 | 250 | 250 | 350 |
| Hydroxyethyl Cellulose | (g) | 2.0 | 2.0 | 2.0 | 2.0 | 2.0 | 2.0 |
| Type of Transferred Imege | | Positive | Positive | Not Transferred | Positive | Not Transferred | Positive |

While the invention has been described in detail and with reference to specific embodiments thereof, it will be apparent to one skilled in the art that various changes and modifications can be made therein without departing from the spirit and scope thereof.

What is claimed is:

1. A diffusion transfer photographic process comprising imagewise exposing a silver halide photosensitive emulsion layer and processing with an alkali processing solution in the presence of a silver halide solvent, a silver halide developing agent, said silver halide of said emulsion layer, and a development solubilization promoter that forms an insoluble complex compound by reaction with said silver halide of said emulsion layer, to form a black and white negative transfer image on an image-receiving layer, wherein the improvement comprises using a silver halide photosensitive emulsion layer wherein the silver halide in the emulsion layer is silver iodobromochloride or silver iodobromide wherein the iodide comprises from 10 to 20 mole% of the halide content thereof.

2. A diffusion transfer photographic process as in claim 1, wherein said silver halide developing agent is present in the alkali processing solution in an amount of from about 1 to 80 g per liter.

3. A diffusion transfer photographic process as in claim 1, wherein said silver halide developing agent is present in the alkali processing solution in an amount from 5 to 60 g per liter.

4. A diffusion transfer photographic process as in claim 1, wherein the silver halide developing agent is incorporated in the silver halide photographic sensitive emulsion layer in a ratio of moles of developing agent-/moles of silver halide of from about 1/50 to 1/1.

5. A diffusion transfer photographic process as in claim 1, wherein the silver halide developing agent is incorporated in the silver halide photographic sensitive emulsion layer in a ratio of moles of developing agent-/moles of silver halide of from 1/10 to $\frac{3}{4}$.

6. A diffusion transfer photographic process as in claim 1, wherein the development solubilization promoter is in the alkali processing solution and the amount of the promoter in the alkali processing solution is from about 10 mg to 10 g per liter of alkali processing solution.

7. A diffusion transfer photographic process as in claim 1, wherein the development solubilization promoter is in the alkali processing solution and the amount of the promoter in the alkali processing solution is from about 20 mg to 8 g per liter of alkali processing solution.

8. A diffusion transfer photographic process as in claim 1, wherein the promoter is incorporated in the silver halide photographic sensitive emulsion layer in an amount of from about 0.6 mg to 600 mg per mole of silver halide.

9. A diffusion transfer photographic process as in claim 1, wherein the promoter is incorporated in the silver halide photographic sensitive emulsion layer in an amount of from 6 mg to 300 mg.

10. A diffusion transfer photographic process as in claim 1, wherein the pH of the alkali processing solution is at least 11.5.

11. A diffusion transfer photographic process as in claim 1, wherein the pH of the alkali processing solution is at least 12.5.

12. A diffusion transfer photographic process as in claim 1, wherein the silver halide photosensitive emulsion layer contains from about 0.5 to 10 g of silver halide per square meter.

13. A diffusion transfer photographic process as in claim 1, wherein the silver halide photosensitive emulsion layer contains from 1.0 to 5.0 g of silver halide per square meter.

* * * * *